US011441391B2

(12) United States Patent
El-Mahbes et al.

(10) Patent No.: US 11,441,391 B2
(45) Date of Patent: Sep. 13, 2022

(54) DOWNHOLE SAND SCREEN WITH AUTOMATIC FLUSHING SYSTEM

(71) Applicant: Baker Hughes, a GE Company, LLC, Houston, TX (US)

(72) Inventors: Reda El-Mahbes, Houston, TX (US); Jordan Kirk, Tulsa, OK (US); Leslie Reid, Tulsa, OK (US)

(73) Assignee: Baker Hughes, a GE Company, LLC, Houston, TX (US)

( * ) Notice: Subject to any disclaimer, the term of this patent is extended or adjusted under 35 U.S.C. 154(b) by 0 days.

(21) Appl. No.: 16/694,939

(22) Filed: Nov. 25, 2019

(65) Prior Publication Data

US 2020/0165908 A1 May 28, 2020

Related U.S. Application Data

(60) Provisional application No. 62/771,850, filed on Nov. 27, 2018.

(51) Int. Cl.
*E21B 37/08* (2006.01)
*E21B 43/12* (2006.01)

(52) U.S. Cl.
CPC ..... *E21B 37/08* (2013.01); *E21B 43/122* (2013.01); *E21B 43/127* (2013.01); *E21B 43/128* (2013.01)

(58) Field of Classification Search
CPC .... E21B 43/128; E21B 43/127; E21B 43/122; E21B 37/08; E21B 43/00; E21B 43/02; E21B 43/34; E21B 43/04; C02F 1/44
See application file for complete search history.

(56) References Cited

U.S. PATENT DOCUMENTS

| | | | | |
|---|---|---|---|---|
| 2,355,259 | A | 8/1944 | Bancroft | |
| 4,253,481 | A * | 3/1981 | Sarlls, Jr. ..... | F16K 11/044 137/112 |
| 5,433,269 | A | 7/1995 | Hendrickson | |
| 5,660,533 | A | 8/1997 | Cartwright | |
| 6,186,227 | B1 | 2/2001 | Vaynshteyn et al. | |
| 6,315,050 | B2 | 11/2001 | Vaynshteyn et al. | |
| 6,564,876 | B2 | 5/2003 | Vaynshteyn et al. | |
| 6,899,176 | B2 | 5/2005 | Hailey, Jr. et al. | |
| 7,387,158 | B2 | 6/2008 | Murray et al. | |
| 7,552,777 | B2 | 6/2009 | Murray et al. | |
| 8,322,450 | B2 | 12/2012 | Meijer | |

(Continued)

FOREIGN PATENT DOCUMENTS

| | | |
|---|---|---|
| CN | 108386160 A | 8/2018 |
| WO | 2012169904 A2 | 12/2012 |

OTHER PUBLICATIONS

International Search Report and Written Opinion issued in connection with corresponding PCT Application No. PCT/US2019/063096 dated Mar. 31, 2020.

(Continued)

*Primary Examiner* — Tara Schimpf
(74) *Attorney, Agent, or Firm* — Crowe & Dunlevy, P.C.

(57) ABSTRACT

A pump that is configured to lift fluids through a tubing string includes a gas mitigation system and a screen flush module. The gas mitigation system has a canister with an interior and an intake screen. The gas mitigation system further includes an intake tube that extends into the canister. The screen flush module is configured to flush solids particles trapped in the intake screen.

12 Claims, 7 Drawing Sheets

(56) References Cited

U.S. PATENT DOCUMENTS

| | | | | |
|---|---|---|---|---|
| 8,998,586 | B2 | 4/2015 | Muhs | |
| 9,447,661 | B2 | 9/2016 | Broussard et al. | |
| 9,447,788 | B2 * | 9/2016 | Henry | F04B 47/02 |
| 2002/0023750 | A1 * | 2/2002 | Lopes | E21B 43/38 166/265 |
| 2004/0129432 | A1 | 7/2004 | Wills et al. | |
| 2005/0199551 | A1 | 9/2005 | Gordon | |
| 2005/0281683 | A1 | 12/2005 | Brown et al. | |
| 2009/0065202 | A1 | 3/2009 | Brown et al. | |
| 2010/0206732 | A1 | 8/2010 | Hale | |
| 2011/0180272 | A1 * | 7/2011 | Head | E21B 17/028 166/378 |
| 2012/0057965 | A1 | 3/2012 | Bergamini et al. | |
| 2013/0075105 | A1 | 3/2013 | Morton | |
| 2013/0306330 | A1 | 11/2013 | Bishop et al. | |
| 2014/0332239 | A1 | 11/2014 | Porta | |
| 2015/0053394 | A1 | 2/2015 | Reid et al. | |
| 2015/0098840 | A1 | 4/2015 | Kowalchuk | |
| 2015/0204158 | A1 | 7/2015 | Frisby et al. | |
| 2015/0205158 | A1 | 7/2015 | Engel et al. | |
| 2015/0275619 | A1 | 10/2015 | Slup | |
| 2015/0345276 | A1 | 12/2015 | Jensen | |
| 2016/0130919 | A1 | 5/2016 | Vasques | |
| 2016/0222770 | A1 | 8/2016 | Kirk et al. | |
| 2017/0175468 | A1 * | 6/2017 | Vail, III | E21B 21/12 |
| 2017/0342798 | A1 | 11/2017 | Wutherich | |
| 2018/0171763 | A1 | 6/2018 | Malbrel et al. | |
| 2018/0179852 | A1 | 6/2018 | Hou et al. | |
| 2018/0223642 | A1 | 8/2018 | Zahran | |
| 2018/0298736 | A1 | 10/2018 | Bailey et al. | |

OTHER PUBLICATIONS

European Patent Office; Supplementary European Search Report, EP Application 19 89 0499; dated Jul. 21, 2022.

* cited by examiner

DOWNHOLE SAND SCREEN WITH AUTOMATIC FLUSHING SYSTEM

RELATED APPLICATIONS

This application claims the benefit of U.S. Provisional Patent Application Ser. No. 62/771,850 filed Nov. 27, 2018 entitled "Downhole Sand Screen with Automatic Flushing System," the disclosure of which is herein incorporated by reference.

FIELD OF THE INVENTION

This invention relates generally to oilfield equipment, and in particular to intake screens used in downhole pumps.

BACKGROUND

Hydrocarbons are often produced from wells with reciprocating downhole pumps that are driven from the surface by pumping units. A pumping unit is connected to its downhole pump by a rod string. Although several types of pumping units for reciprocating rod strings are known in the art, walking beam style pumps enjoy predominant use due to their simplicity and low maintenance requirements.

In other applications, electric submersible pumping systems are deployed in a well and used to push fluids to the surface. The electric submersible pumping system often includes a multistage centrifugal pump that is driven by a high-powered electric motor. Each of the components within the electric submersible pumping system must be sized and configured to be deployed within the wellbore.

Some wells produce a significant amount of sand and other particulates, which may accelerate wear on downhole pumps. To mitigate this wear, sand screens are sometimes used to reduce the intake of sand and other particulates into the downhole pumps. The sand screens may include mesh or perforated screens that cover the intake to the downhole pump. Although generally effective at reducing the ingestion of solids into the pumping systems, sand screens may become clogged to an extent that the pumps are incapable of efficiently drawing fluids from the wellbore. When the screen becomes clogged, the pumping system must be removed from the well so that the sand screen can be cleaned or replaced. This introduces significant cost and downtime that is undesirable. There is, therefore, a need for an improved sand screen system that overcomes these and other deficiencies in the prior art.

SUMMARY OF THE INVENTION

In one aspect, embodiments of the present invention include a pump configured to lift fluids through a tubing string contained in a well having a well casing. The pump includes a gas mitigation system that has a canister with an interior and an intake screen. The gas mitigation system further includes an intake tube that extends into the canister. The pump also includes a screen flush module that is configured to flush solids particles trapped in the intake screen.

In some embodiments, the pump is a reciprocating pump and the screen flush module includes a dump valve that regulates the flow of fluid from the tubing string to the gas mitigation system. In other embodiments, the pump is an electric submersible pump and the screen flush module includes a flush diverter positioned within the tubing string. The flush diverter includes a housing that has a central passage and a flush discharge connected to the central passage. The screen flush module further includes a flush line connected between the flush discharge and the interior of the canister. A shuttle valve in the screen flush module selectively opens the flush discharge to permit pressurized fluid to pass through the flush line into the interior of the canister during a flush mode of operation.

WRITTEN DESCRIPTION

Figure 1:
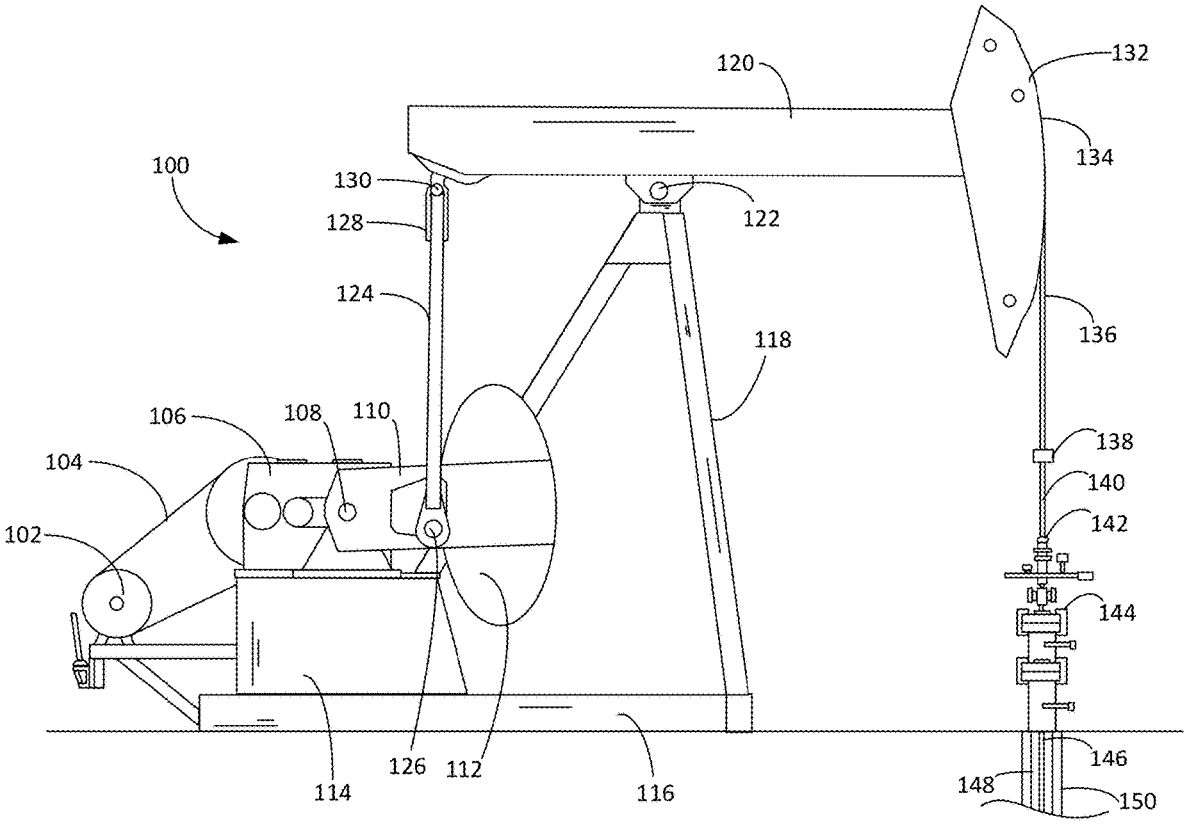
FIG. 1 is a side view of a beam pumping unit and well head.

FIG. 1 shows a beam pump 100 constructed in accordance with an exemplary embodiment of the present invention. The beam pump 100 is driven by a prime mover 102, typically an electric motor or internal combustion engine. The rotational power output from the prime mover 102 is transmitted by a drive belt 104 to a gearbox 106. The gearbox 106 provides low-speed, high-torque rotation of a crankshaft 108. Each end of the crankshaft 108 (only one is visible in FIG. 1) carries a crank arm 110 and a counterbalance weight 112. The reducer gearbox 106 sits atop a sub-base or pedestal 114, which provides clearance for the crank arms 110 and counterbalance weights 112 to rotate. The gearbox pedestal 114 is mounted atop a base 116. The base 116 also supports a Samson post 118. The top of the Samson post 118 acts as a fulcrum that pivotally supports a walking beam 120 via a center bearing assembly 122.

Each crank arm 110 is pivotally connected to a pitman arm 124 by a crank pin bearing assembly 126. The two pitman arms 124 are connected to an equalizer bar 128, and the equalizer bar 128 is pivotally connected to the rear end of the walking beam 120 by an equalizer bearing assembly 130, commonly referred to as a tail bearing assembly. A horse head 132 with an arcuate forward face 134 is mounted to the forward end of the walking beam 120. The face 134 of the horse head 132 interfaces with a flexible wire rope bridle 136. At its lower end, the bridle 136 terminates with a carrier bar 138, upon which a polish rod 140 is suspended.

The polish rod 140 extends through a packing gland or stuffing box 142 on a wellhead 144. A rod string 146 of sucker rods hangs from the polish rod 140 within a tubing string 148 located within the well casing 150. The rod string 146 is connected to the plunger and traveling valve of a subsurface reciprocating pump 152 (depicted in FIG. 2). In a reciprocating cycle of the beam pump 100, well fluids are lifted within the tubing string 148 during the rod string 146 upstroke.

Figure 2A:
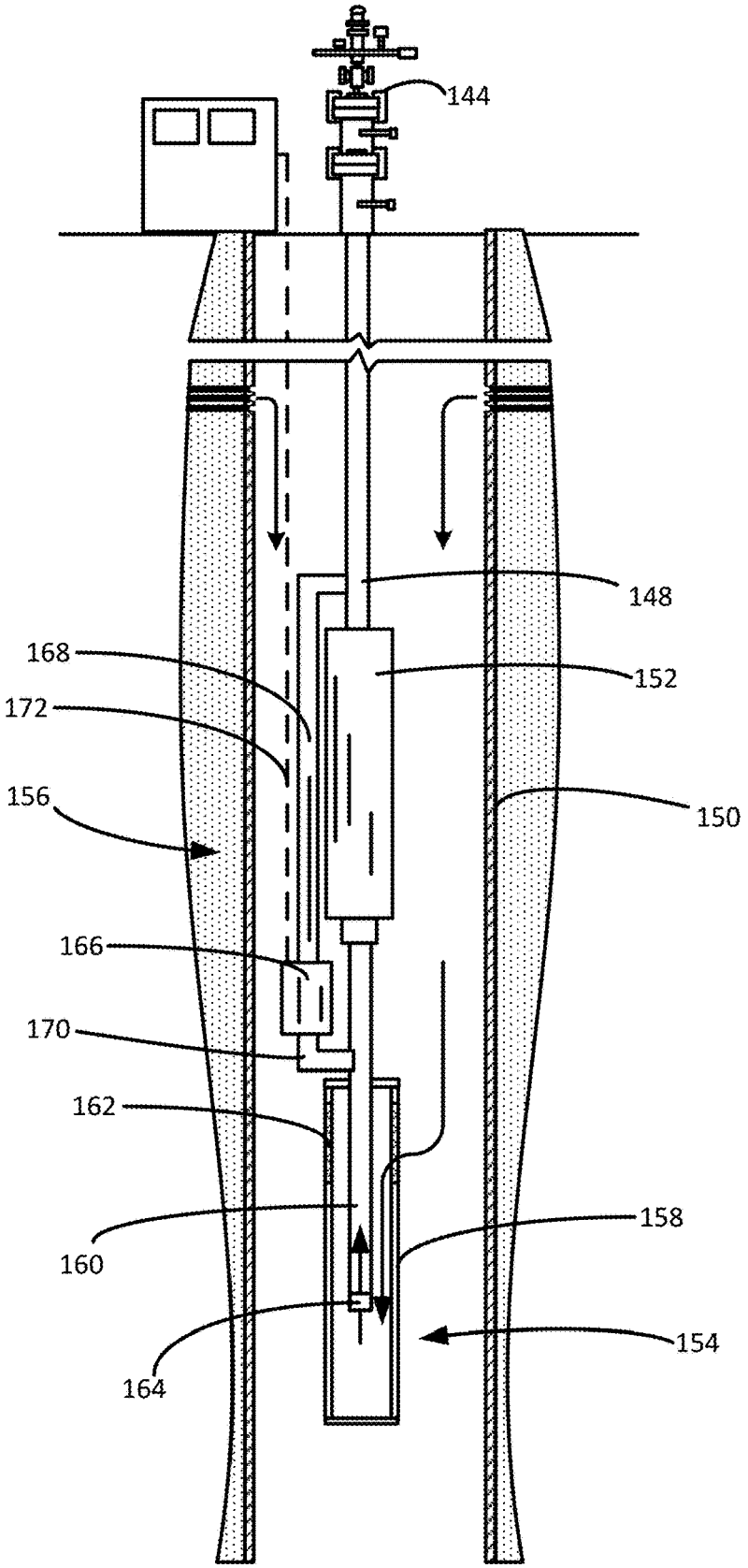
FIG. 2A is a side view of a first embodiment of a downhole reciprocating pump and screen flush module.
Figure 2B:
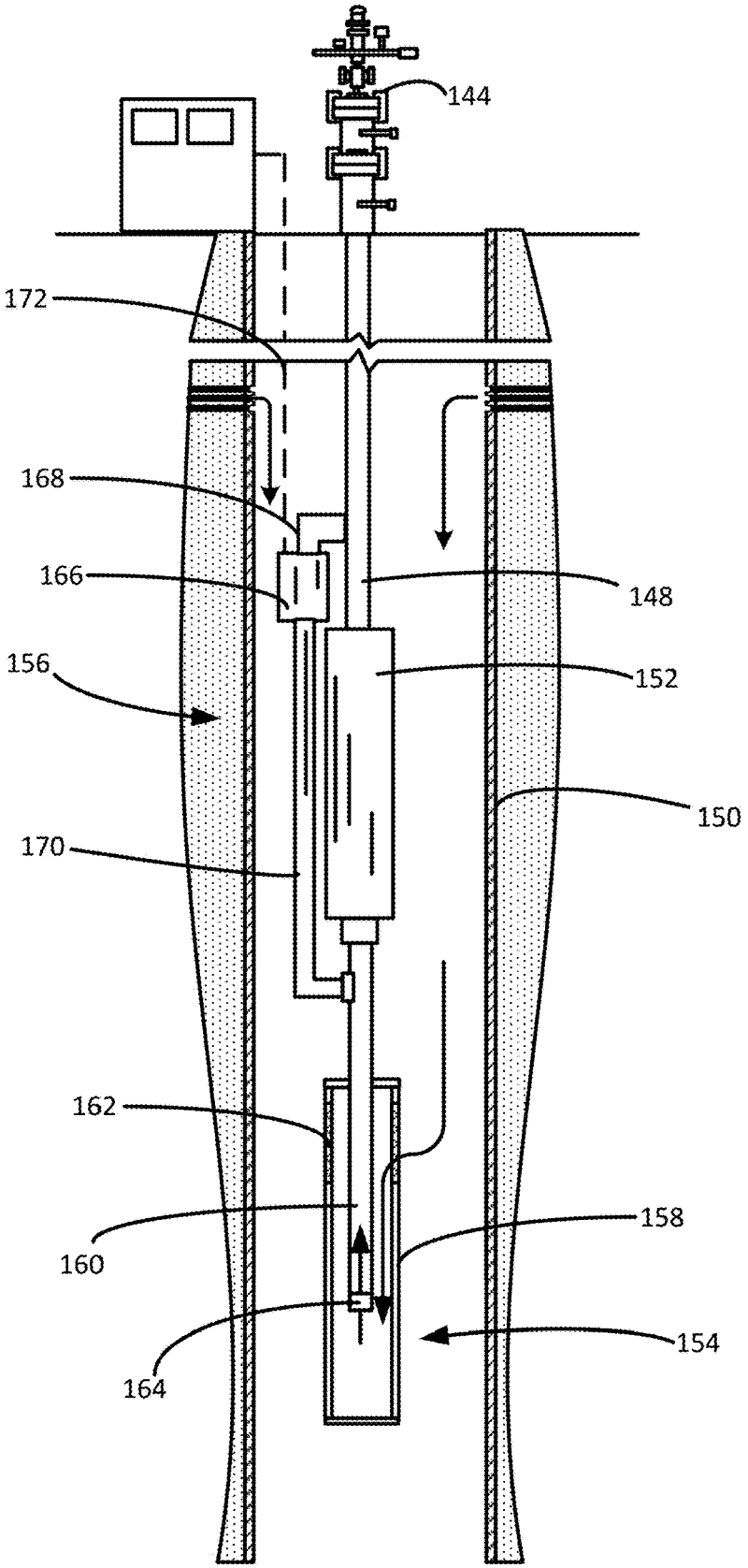
FIG. 2B is a side view of a second embodiment of a downhole reciprocating pump and screen flush module.
Figure 2C:
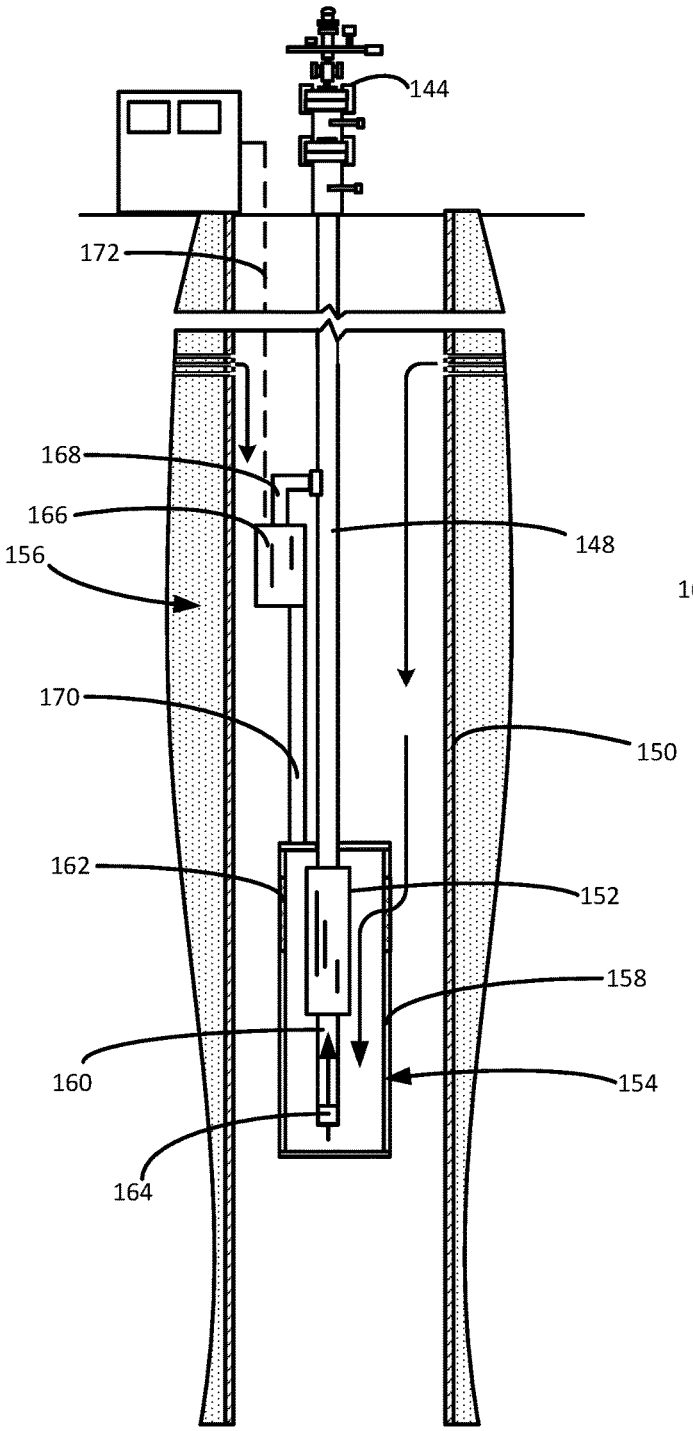
FIG. 2C is a side view of a third embodiment of a downhole reciprocating pump and screen flush module.
Figure 2D:
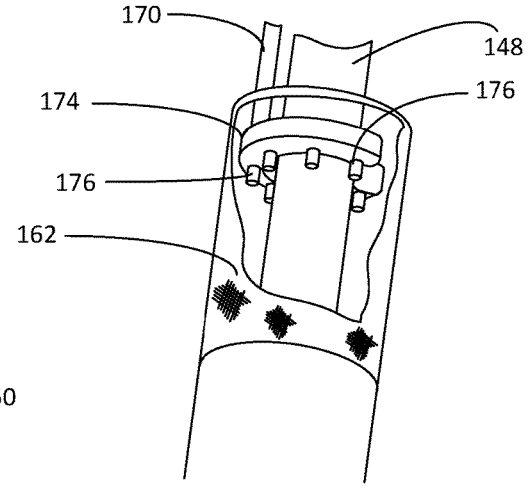
FIG. 2D is a close-up partial cutaway view of the screen flush module from FIG. 2C.

Turning to FIGS. 2A, 2B and 2C, shown therein are depictions of a gas mitigation system 154 and screen flush module 156 deployed within the well casing 150. The gas mitigation system 154 includes a canister 158 and an intake tube 160 positioned within the canister 158. The canister 158 includes an intake screen 162 that admits fluids into the canister 158, while filtering out sand and other particles that are larger than the mesh size of the intake screen 162. In some embodiments, the intake screen 162 is manufactured from wire mesh, perforated plates or metal grating. As noted in FIG. 2, the intake tube 160 has an open end 164 positioned below the intake screen 162. In some embodiments, the open end 164 includes a one-way check valve that permits the flow of fluids into the intake tube 160 while preventing fluids from being discharged into the canister 158 through the intake tube 160.

The intake tube 160 extends from the lower end of the canister 158 to the screen flush module 156. The placement of the open end 164 of the intake tube 160 below the intake screen 162 reduces the amount of gas that is drawn into the intake tube 160. Lighter gaseous components are trapped near the top of the canister 158, while heavier liquid components are allowed to fall to the bottom of the canister 158 to the open end 164. This produces a liquid-enriched reservoir inside the canister 158, which can be drawn into the pump components through the intake tube 160. Thus, during large gas slugging events, the beam pump unit 100 can continue to operate efficiently using the liquid reserve contained in the gas mitigation system 154.

In the embodiments depicted in FIGS. 2A and 2B, the reciprocating pump 152 is positioned above the gas mitigation system 154. In the embodiment depicted in FIG. 2C, the reciprocating pump 152 is located inside the gas mitigation system 154. It will be appreciated that these drawings are broadly representative of the function and interrelationships between the various components within the depicted systems, but that the various components identified therein are not drawn to scale.

The screen flush module 156 includes a dump valve 166, an inlet line 168, an outlet line 170, and a control line 172. Generally, the dump valve 166 remains closed during normal production from the reciprocating pump 152. When selectively opened, the dump valve 166 permits a volume of fluid to backwash the intake screen 162 of the gas mitigation system 154.

In FIG. 2A, the dump valve 166 is positioned between the canister 158 and the reciprocating pump 152. In the embodiment depicted in FIG. 2B, the dump valve 166 is positioned above the reciprocating pump 152. In the embodiments depicted in FIGS. 2A and 2B, the inlet line 168 is tapped into the tubing string and the outline line 170 is configured to discharge into the intake tube 160. In the embodiment depicted in FIG. 2C, the inlet line 168 is tapped into the tubing string 148 and the outlet line 170 is configured to discharge directly into the canister 158. As noted in FIG. 2D, the screen flush module 156 may optionally include a flush manifold 174 that has a plurality of nozzles 176 that distribute the pressurized fluid around the interior of the canister 158. The outlet line 170 can be connected to the flush manifold 174.

Figure 3A:
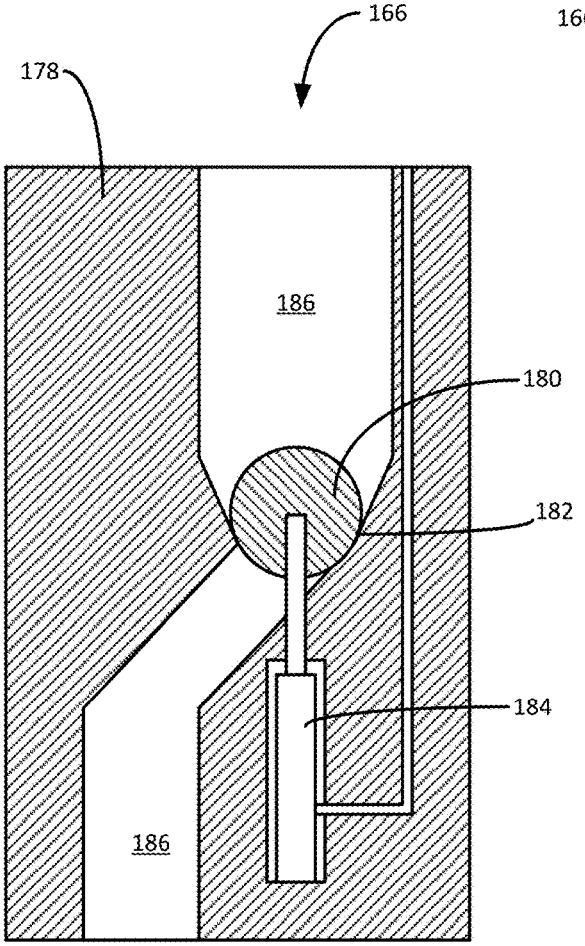
FIG. 3A is a cross-sectional view of an embodiment of the dump valve in a closed position.
Figure 3B:
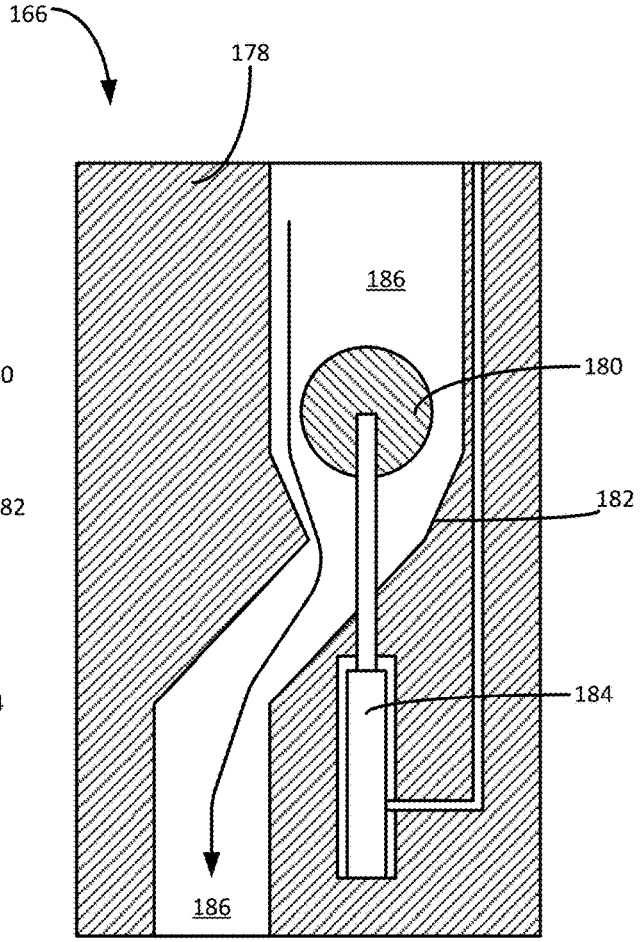
FIG. 3B is a cross-sectional view of an embodiment of the dump valve in an open position.

Turning to FIGS. 3A and 3B, shown therein are cross-sectional depictions of an embodiment of the dump valve 166. The dump valve 166 generally includes a body 178, a ball valve 180, a ball valve seat 182, an actuator 184 and a central passage 186. The ball valve seat 182 is positioned within the central passage 186. In the closed position depicted in FIG. 3A, the ball valve 180 is positioned against the ball valve seat 182 to prevent fluid from passing through the central passage 186. The hydrostatic pressure produced by the column of fluid above the seated ball valve 180 biases the ball valve 180 into the closed position. When selectively energized, the actuator 184 extends to force the ball valve 180 off the ball valve seat 182, as depicted in FIG. 3B, to allow fluid above the dump valve 166 to rapidly pass through the dump valve 166 into the outlet line 170. In some embodiments, the actuator 184 includes a hydraulically-driven ram and the control line 172 provides a source of pressurized hydraulic fluid to the actuator 184 from the surface. In other embodiments, the actuator 184 is a solenoid, screw-drive or other electrically-driven system that receives a source of electric current through the control line 172.

In this way, when the screen flush module 156 is placed into a "flush" mode of operation, the dump valve 166 is opened and pressurized fluid is discharged into the canister 158 to dislodge and expel sand and other particles trapped in the intake screen 162. The flush mode of operation can be automatically triggered by detecting operating conditions of the downhole components, including reduced flow into the reciprocating pump 152 or an increased pressure gradient across the intake screen 162. When the flushing operation is complete, the operator or automated pump control system can return the screen flush module 156 to a normal pumping mode by closing the dump valve 166.

In addition to permitting the flush mode of operation, the dump valve 166 also allows the operator to pump treatment chemicals down the tubing string 148 to a location in the well casing 150 below the reciprocating pump 152. In conventional reciprocating pump installations, the traveling and standing valves frustrate efforts to pump treatment chemicals through the reciprocating pump. The well treatment process can be performed by pumping a well treatment composition down the tubing string 148 and opening the dump valve 166 with the control line 172. The well treatment composition bypasses the reciprocating pump 152 and flows through inlet line 168, the open dump valve 166, the outlet line 170, and the canister 158 of the gas mitigation system 156 to the annular space in the well casing 150 below the reciprocating pump 152. It will be appreciated that use of the dump valve 166, the inlet line 168 and the outlet line 170 will find utility for well treatment processes even in applications where the gas mitigation system 154 is not deployed.

Figure 4:
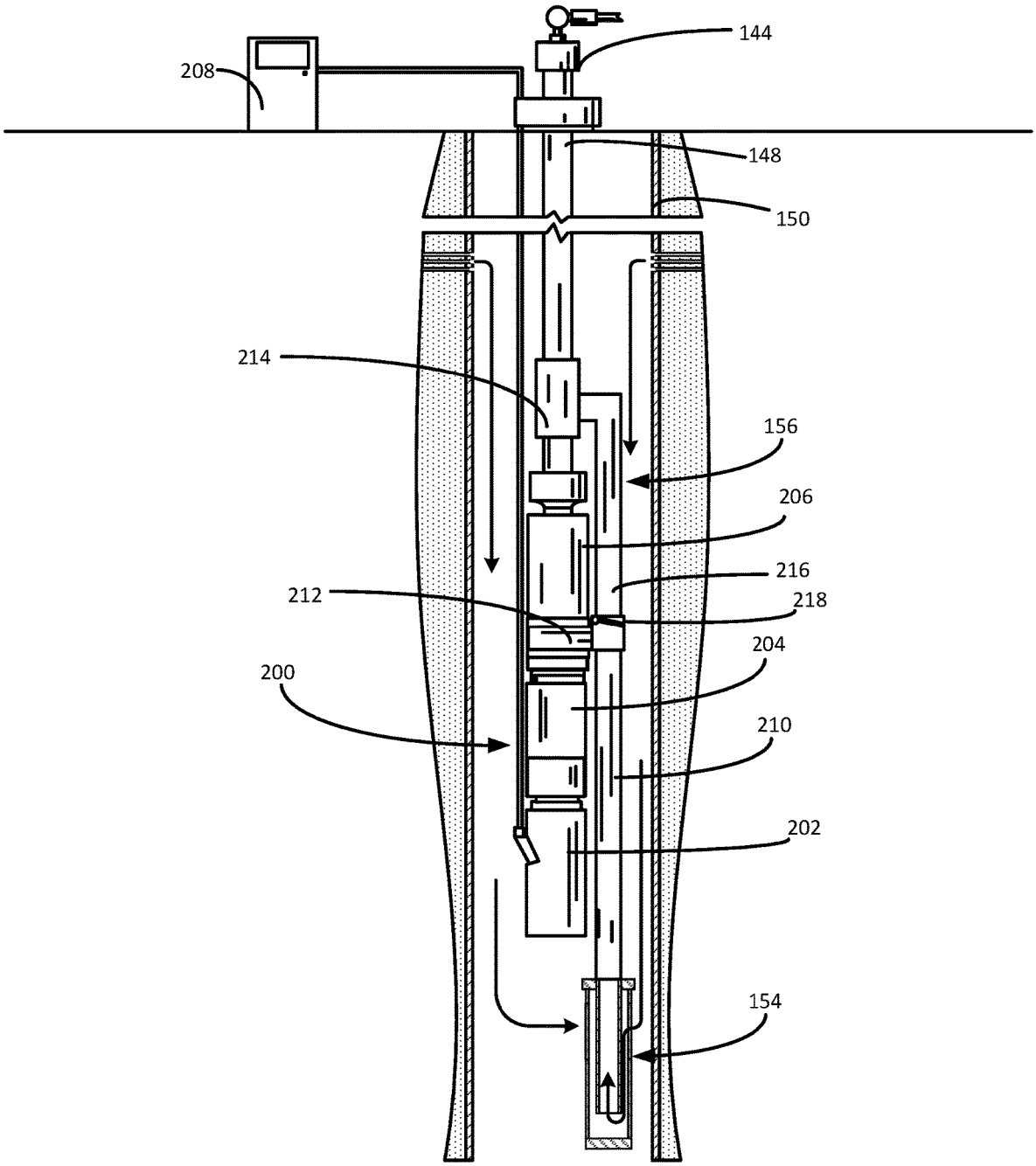
FIG. 4 is a depiction of a second embodiment in which a screen flush module is connected to an electric submersible pumping system.

Although the screen flush module 156 is depicted in FIGS. 1-3 in combination with the reciprocating pump 152, it will be appreciated that the screen flush module 156 will find utility in other applications in which a pumping system has a screened intake. For example, FIG. 4 depicts the use of an alternate embodiment of the screen flush module 156 in combination with an electric submersible pump 200. The electric submersible pump 200 includes a motor 202, a seal section 204 and a pump 206. When energized by a motor drive 208 positioned on the surface, the motor 202 drives the pump 206 to evacuate fluids through the tubing string 148. The pump 206 includes a bottom intake pipe 210 that extends from an intake manifold 212 to the gas mitigation system 154.

In this embodiment, the screen flush module 156 includes a flush diverter 214 within the tubing string 148 and a wash line 216 connected between the flush diverter 214 and the intake manifold 212. The screen flush module 156 optionally includes a check valve 218 within the intake manifold 212 that closes the intake of the pump 206 when pressurized fluid is present in the wash line 216.

Figure 5A:
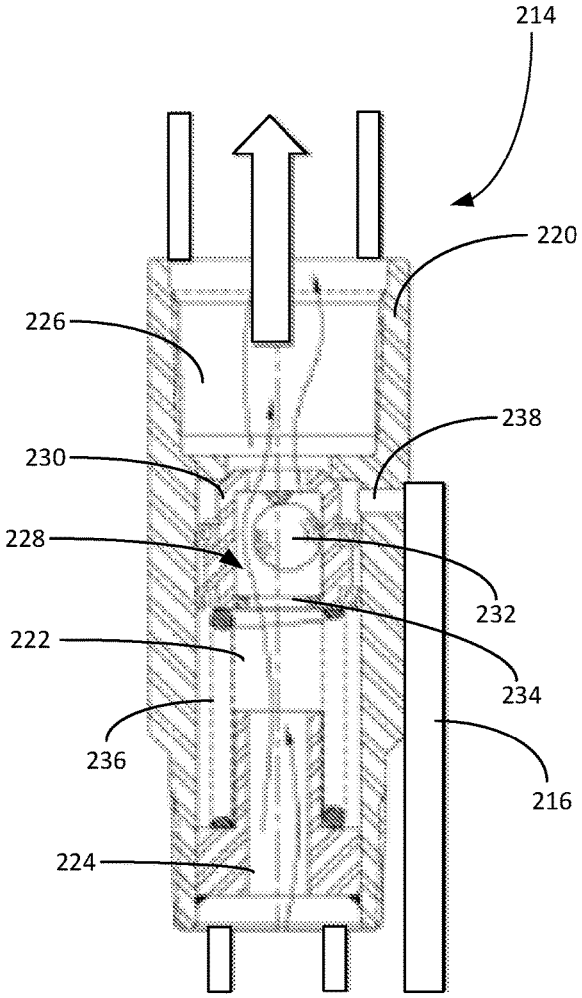
FIG. 5A is a cross-sectional view of an embodiment of the shuttle valve in an open, producing position.
Figure 5B:
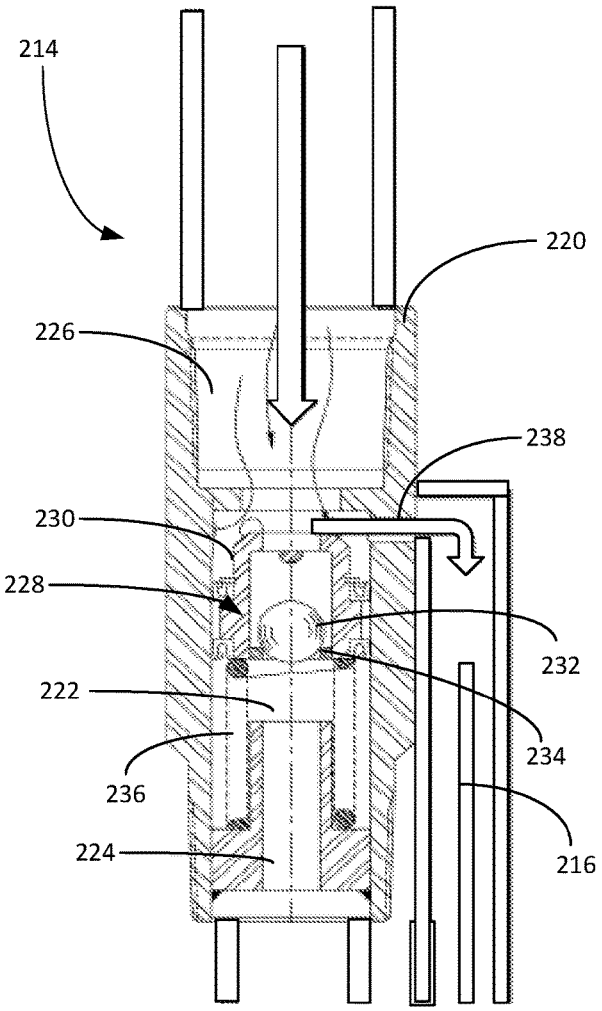
FIG. 5B is a cross-sectional view of an embodiment of the dump valve in a closed, flushing position.

FIGS. 5A and 5B depict an embodiment of the flush diverter 214. The flush diverter 214 includes an outer housing 220 through which a central passage 222 connects a production intake 224 to a production discharge 226. A shuttle valve 228 is contained within the central passage 222. The shuttle valve 228 includes a cage 230, a check ball 232 contained within the cage 230, and a valve seat 234. The shuttle valve 228 includes a spring 236 that biases the cage 230 into an "open" position in which the check ball 232 is displaced from the valve seat 234. The flush diverter 214 further includes a flush discharge 238 that connects the central passage 222 to the wash line 216.

When the cage 230 is placed in the "open" position (as depicted in FIG. 5A), the cage 230 blocks the flush discharge 238 and prevents fluid passing from the central passage 222 into the wash line 216. When the shuttle valve 228 closes (as depicted in FIG. 5B), the cage 230 compresses the spring 236 and drops to the valve seat 234 to reveal the flush discharge 238. The shuttle valve 228 is closed when the pressure applied to the top of the cage 230 and check ball 232 exceeds the combined force produced by the spring 236 and the fluid pressure acting on the bottom of the cage 230 and the check ball 232. The shuttle valve 228 can be closed, for example, by pumping fluid from the surface down through the tubing string 148 to force the check ball 232 against the valve seat 234.

When the shuttle valve 228 is closed, pressurized fluids are diverted by the shuttle valve 228 into the flush discharge 238. Pressurized fluids are forced from the central passage 222, through the flush discharge 238, through the wash line 216 to the canister 158. Reducing the fluid pressure within the flush diverter 214 allows the shuttle valve 228 to return to an open position that permits production of fluids through the flush diverter 214 while blocking the flush discharge 238.

Thus, during normal pumping operation, the screen flush module 156 and gas mitigation system 154 cooperate to reduce the amount of gas and solids that are drawn into the pump 206. When the intake screen 162 of the gas mitigation system 154 becomes occluded to a threshold extent, the screen flush module 156 can be placed into the "flush" mode of operation by forcing fluid down the tubing string 148 to the flush diverter 214. In some embodiments, the screen flush module 156 is configured such that the hydrostatic pressure of the fluid within the tubing string 148 is sufficient to place the flush diverter 214 into the "flush" position. In these embodiments, the screen flush module 156 performs an automatic flushing operation each time the electric submersible pump 200 is turned off. The pressure exerted by the column of fluid above the electric submersible pump 200 forces the shuttle valve 228 within the flush diverter 214 into the closed position and fluid is forced through the wash line 2126 to backwash the intake screen 162 of the gas mitigation system 154.

It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. It will be appreciated by those skilled in the art that the teachings of the present invention can be applied to other systems without departing from the scope and spirit of the present invention.

What is claimed is:

1. An electric submersible pump configured to lift fluids through a tubing string contained in a well having a well casing, the electric submersible pump comprising:
- an electric motor;
- a centrifugal pump driven by the electric motor when the electric motor is energized, wherein the centrifugal pump includes an intake manifold;
- a gas mitigation system comprising:
  - a canister having an interior; and
  - an intake screen;
- a bottom intake pipe, wherein the bottom intake pipe extends from the interior of the canister to the intake manifold of the centrifugal pump; and
- a screen flush module, wherein the screen flush module comprises:
  - a flush diverter connected to the tubing string above the centrifugal pump;
  - a wash line extending from the flush diverter to the bottom intake pipe through the intake manifold of the centrifugal pump; and
  - wherein the flush diverter is configured to release fluids under hydrostatic pressure within the tubing string above the centrifugal pump into the gas mitigation system to selectively backwash particles trapped by the intake screen of the gas mitigation system.

2. The pump of claim 1, wherein the gas mitigation system further includes a flush manifold that has a plurality of nozzles within the canister.

3. The pump of claim 1, wherein the screen flush module is configured to be automatically placed into a flush mode of operation by the hydrostatic pressure of fluid in the tubing string when the electric motor is not energized.

4. The pump of claim 3, wherein the flush diverter comprises:
- a flush discharge; and
- a shuttle valve that selectively opens the flush discharge to permit pressurized fluid to pass from the tubing string through the flush diverter and into the wash line during the flush mode of operation.

5. The pump of claim 4, wherein the shuttle valve comprises:
- a shuttle cage;
- a check ball contained within the shuttle cage;
- a seat; and
- a spring that biases the shuttle cage in an open position in which the check ball is displaced from the seat.

6. The pump of claim 5, wherein the shuttle valve is configured such that the shuttle cage blocks the flush discharge when the shuttle valve is urged to the open position.

7. The electric submersible pump of claim 1, wherein the screen flush module further comprises a check valve within the intake manifold that closes the intake manifold of the centrifugal pump when the wash line contains pressurized fluid.

8. A pump configured to lift fluids through a tubing string contained in a well having a well casing, the pump comprising:
- an electric motor;
- a centrifugal pump driven by the electric motor when the electric motor is energized;
- a gas mitigation system comprising:
  - a canister having an interior and an intake screen; and an intake tube, wherein the intake tube extends from inside the canister to the centrifugal pump; and a screen flush module, wherein the screen flush module comprises:

a dump valve above the canister of the gas mitigation system;

an inlet line, wherein the inlet line connects the tubing string to the dump valve;

an outlet line, wherein the outlet line connects the dump valve to the intake tube below the centrifugal pump; and wherein the dump valve is configured to release fluids under hydrostatic pressure within the inlet line and tubing string above the dump valve into the gas mitigation system through the outlet line to selectively backwash particles trapped by the intake screen of the gas mitigation system.

9. The pump of claim 8, wherein the dump valve comprises:

a central passage;

a ball valve seat within the central passage;

a ball valve; and an actuator to selectively lift the ball valve off the ball valve seat to permit fluid flow through the central passage, wherein the actuator includes a hydraulically-driven ram that is connected to the ball valve.

10. A pump configured to lift fluid through a tubing string contained in a well having a well casing, the pump comprising:

an electric motor;

a centrifugal pump driven by the electric motor when the electric motor is energized;

a gas mitigation system comprising:

a canister having an interior; and an intake screen;

a bottom intake pipe, wherein the bottom intake pipe extends from the interior of the canister to the centrifugal pump; and a screen flush module configured to selectively backwash particles trapped by the intake screen of the gas mitigation system, wherein the screen flush module comprises:

a wash line connected to the gas mitigation system; and a flush diverter connected to the tubing string, wherein the flush diverter comprises:

a flush discharge; and a shuttle valve that selectively opens the flush discharge to permit pressurized fluid to pass through the wash line into the interior of the canister during the flush mode of operation; and;

wherein the screen flush module is configured to be automatically placed into a flush mode of operation by a hydrostatic pressure of the fluid in the tubing string when the electric motor is not energized.

11. The pump of claim 10, wherein the shuttle valve comprises:

a shuttle cage;

a check ball contained within the shuttle cage;

a seat;

a spring that biases the shuttle cage in an open position in which the check ball is displaced from the seat; and wherein the shuttle valve is configured such that the shuttle cage blocks the flush discharge when the shuttle valve is urged to the open position while the electric motor is energized.

12. The electric submersible pump of claim 10, wherein the screen flush module further comprises a check valve within the intake manifold that closes the intake manifold of the centrifugal pump when the wash line contains pressurized fluid.

* * * * *